United States Patent [19]

Yu

[11] Patent Number: 5,008,167

[45] Date of Patent: Apr. 16, 1991

[54] INTERNAL METAL OXIDE FILLED MATERIALS FOR ELECTROPHOTOGRAPHIC DEVICES

[75] Inventor: Robert C. U. Yu, Webster, N.Y.

[73] Assignee: Xerox Corporation, Stamford, Conn.

[21] Appl. No.: 451,240

[22] Filed: Dec. 15, 1989

[51] Int. Cl.[5] ..... G03G 5/14

[52] U.S. Cl. ..... 430/56; 430/57; 430/523; 430/525; 430/527; 430/63; 252/518; 428/328; 428/329; 428/220

[58] Field of Search ..... 428/328, 329, 220; 430/58, 69, 63, 56, 57

[56] References Cited

U.S. PATENT DOCUMENTS

| | | | |
|---|---|---|---|
| 3,121,006 | 2/1964 | Middleton et al. | 430/31 |
| 3,357,989 | 12/1967 | Byrne et al. | 430/78 |
| 3,442,781 | 5/1969 | Weinberger | 430/76 |
| 4,091,145 | 5/1978 | Endo et al. | 428/546 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,402,593 | 9/1983 | Bernard et al. | 355/3 BE |
| 4,409,309 | 10/1983 | Oka | 430/65 |
| 4,415,639 | 11/1983 | Horgan | 430/57 |
| 4,519,698 | 5/1983 | Kohyama et al. | 355/15 |
| 4,521,457 | 6/1985 | Russell et al. | 427/286 |
| 4,647,521 | 3/1987 | Oguchi et al. | 430/58 |
| 4,654,284 | 3/1987 | Yu et al. | 430/59 |
| 4,664,995 | 5/1987 | Horgan et al. | 430/59 |
| 4,675,262 | 6/1987 | Tanaka | 430/58 |
| 4,678,731 | 7/1987 | Yoshizawa et al. | 430/65 |
| 4,702,980 | 10/1987 | Matsuura et al. | 430/63 |
| 4,713,308 | 12/1987 | Yoshizawa et al. | 430/65 |
| 4,717,637 | 1/1988 | Yoshizawa et al. | 430/65 |

*Primary Examiner*—David Welsh
*Attorney, Agent, or Firm*—Oliff & Berridge

[57] ABSTRACT

In an electrophotographic imaging device, material for various exposed layers and members is provided having metal oxide particles homogeneously dispersed therein. The metal oxide particles provide coefficient of surface contact friction reduction, increased wear resistance, durability against tensile cracking, and improved adhesion of the layers without adversely affecting the optical and electrical properties of the imaging member. The metal oxide particles are three-dimensional, highly crosslinked network structures having an average particle size of about 200 Angstroms.

28 Claims, 1 Drawing Sheet

INTERNAL METAL OXIDE FILLED MATERIALS FOR ELECTROPHOTOGRAPHIC DEVICES

BACKGROUND OF THE INVENTION

This invention relates in general to electrophotography and, in particular, to an electrophotoconductive imaging member having an electrically conductive ground strip layer.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

Other composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

Imaging members are generally exposed to repetitive electrophotographic cycling which subjects exposed layers of imaging devices to abrasion, chemical attack, heat and multiple exposures to light. This repetitive cycling leads to a gradual deterioration in the mechanical and electrical characteristics of the exposed layers. For example, repetitive cycling has adverse effects on exposed portions of the imaging member, such as the ground strip, charge transport layer, and anti-curl back coatings. Attempts have been made to overcome these problems. However, the solution of one problem often leads to additional problems.

For example, in order to image an electrophotographic imaging member, the conductive layer must be brought into electrical contact with a source of fixed potential elsewhere in the imaging device. This electrical contact must be effective over many thousands of imaging cycles in automatic imaging devices. Since the conductive layer is frequently a thin vapor deposited metal, long life cannot be achieved with an ordinary electrical contact that rubs directly against the thin conductive layer. One approach to minimize the wear of the thin conductive layers is to use a grounding brush such as that described in U.S. Pat. No. 4,402,593. However, such an arrangement is generally not suitable for extended runs in copiers, duplicators and printers Another approach to improve electrical contact between the thin conductive layer of flexible electrophotographic imaging members and a grounding means is the use of a relatively thick electrically conductive grounding strip layer in contact with the conductive layer and adjacent to one edge of the photoconductive or dielectric imaging layer. Generally, the grounding strip layer comprises opaque conductive particles dispersed in a film forming binder. This approach to grounding the thin conductive layer increases the overall life of the imaging layer because of its increased durability. However, such a relatively thick ground strip layer is still subject to abrasion and contributes to the accumulation of undesirable debris. In high volume imaging devices, abrasion is particularly severe in electrophotographic imaging systems utilizing metallic grounding brushes or sliding metal contacts because they often cause the ground strip layer to wear through. Moreover, wear in the ground strip layer may allow light to pass through the ground strip layer in systems utilizing a timing light in combination with a timing aperture for controlling various imaging functions, resulting in false timing signals which causes premature imaging process shut down.

U.S. Pat. No. 4,664,995 discloses an electrostatographic imaging member utilizing a ground strip. The disclosed ground strip material comprises a film forming binder, conductive particles and microcrystalline silica particles dispersed in the film forming binder, and a reaction product of a bi-functional chemical coupling agent which interacts with both the film forming polymer binder and the crystalline silica particles. However, such particles may agglomerate, resulting in impurities being trapped and in uneven optical properties.

Yoshizawa et al U.S. Pat. No. 4,717,637 discloses a microcrystalline silicon barrier layer.

Yoshizawa et al U.S. Pat. No(s). 4,678,731 and 4,713,308 disclose microcrystalline silicon in the photoconductive and barrier layers of a photosensitive member.

Tanaka U.S. Pat. No. 4,675,262 discloses a charge transport layer containing powders having a different refractive index than that of the charge transport layer excluding the powder material. The powder materials include various metal oxides.

Oguchi et al U.S. Pat. No. 4,647,521 discloses the addition of amorphous hydrophobic silica powder to the top layer of a photosensitive member. The silica is of spherical shape and has a size distribution between 10 and 1000 Angstroms. Hydrophobic silica is a synthetic silica having surface silanol (SiOH) groups replaced by hydrophobic organic groups such as $—CH_3$.

If a relatively great frictional force acts between the photosensitive member and a cleaning member, the surface of the photosensitive member may be damaged, and wear off or filming of the toner may result due to the high surface contact friction between the cleaning device and the charge transport layer of the photosensitive member. Wear in the photosensitive member surface caused by high frictional force during machine function reduces the thickness of the charge transport layer. This reduction in charge transport layer thickness increases the electrical field across the layer, and alters electrophotographic performance. Moreover, static electricity generated by friction results in nonuniform surface potential in the charging step, which in turn causes an irregular image formation or fogging. In order to reduce the frictional force, the pressure of the cleaning member, e.g., a cleaning blade, may be reduced. However, by reducing the frictional force, the cleaning blade may not be able to clean the photosensitive member sufficiently, resulting in toner build-up or surface filming.

Other attempts at reducing the frictional force acting between the cleaning blade and the photosensitive member include adding a lubricant such as wax to the toner. However, the fixability of the toner may degrade its electrical function, or further filming may occur, resulting in a degraded image.

A further proposal for reducing frictional force involves applying a lubricant on the surface of the photosensitive drum. Kohyama et al U.S. Pat. No. 4,519,698 discloses a waxy lubricant method to constantly lubricate a cleaning blade. However, the thickness of the lubricant film formed on the photosensitive drum cannot be maintained, and interference with the electrostatic characteristics of the photosensitive member occurs. Attempts have also been made to construct a cleaning blade with a material having a low coefficient of friction. However, these attempts are subject to the problem of degradation in other characteristics, especially mechanical strength, due to the presence of additives.

Another problem in multilayered belt imaging systems includes cracking in one or more critical imaging layers during belt cycling over small diameter rollers. Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value.

When one or more photoconductive layers are applied to a flexible supporting substrate, it has been found that the resulting photoconductive member tends to curl. Coatings may be applied to the side of the supporting substrate opposite the photoconductive layer to counteract the tendency to curl. How ever, difficulties have been encountered with these anti-curl coatings. For example, photoreceptor curl can sometimes still be encountered in as few as 1,500 imaging cycles under the stressful conditions of high temperature and high humidity. Further, it has been found that during cycling of the photoconductive imaging ember in electrophotographic imaging systems, the relatively rapid wear of the anti-curl coating also results in the curling of the photoconductive imaging member. In some tests, the anti-curl coating was completely removed in 150,000 to 200,000 cycles. This wear problem is even more pronounced when photoconductive imaging members in the form of webs or belts are supported in part by stationary guide surfaces which cause the anti-curl layer to wear away very rapidly and produce debris which scatters and deposits on critical machine components such as lenses, corona charging devices and the like, thereby adversely affecting machine performance. Also, the anti-curl coatings occasionally separate from the substrate during extended cycling and render the photoconductive imaging member unacceptable for forming quality images. It has also been found that when long webs of a flexible photoconductor having an anti-curl coating on one side of a supporting substrate and a photoconductive layer on the opposite side of the substrate are rolled into large rolls, dimples and creases form on the photoconductive layer which result in print defects in the final developed images. Further, when the webs are formed into belts, segments of the outer surface of the anti-curl belt in contact with each other during shipment or storage at elevated temperatures also cause creases and dimples to form which are seen as undesirable aberrations in the final printed images. Expensive and elaborate packaging is necessary to prevent the anti-curl coating from contacting itself. Further, difficulties have been encountered in continuous coating machines during the winter manufacturing of the coated photoconductive imaging members because of occasional seizing which prevents transport of the coated web through the machine for downstream processing.

Anti-curl layers will also occasionally delaminate due to poor adhesion to the supporting substrate. Moreover, in electrostatographic imaging systems where transparency of the substrate and anti-curl layer are necessary for rear exposure to activating electromagnetic radiation, any exposure to activating electromagnetic radiation or any reduction of transparency due to opacity of the supporting substrate or anti-curl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity. An anti-curl layer which exhibits the above deficiencies is highly undesirable.

Thus, it is desirable to increase the durability and extend the life of exposed surfaces in an imaging device as well as to reduce frictional contact between members of the imaging device while maintaining electrical and mechanical integrity.

SUMMARY OF THE INVENTION

It is an object of the invention to reduce wear and increase durability of exposed layers in a photosensitive device.

It is also an object of the invention to reduce frictional contact between contacting members in an imaging device.

It is another object of the invention to provide an electrophotographic imaging member having improved wear resistance of the exposed layers, and to maintain the optical and electrical integrity of the layers.

It is still another object of the invention to provide an electrophotographic imaging member that is free of dimples and creases.

It is yet another object of the invention to provide an electrophotographic imaging member with improved charge transport layer resistance to tensile stress cracking.

It is a further object of the present invention to provide an improved electrophotographic imaging member which exhibits greater resistance to layer delamination.

It is still a further object of the present invention to provide internal particulate metal oxide precipitation for increasing wear resistance by direct mixing of liquid chemical reactants into the photoreceptor layer coating solutions.

The present invention overcomes the shortcomings of the prior art by providing a layer in an imaging member comprising in situ precipitated particulate metal oxide. Homogeneously dispersed particles are obtained having a particle diameter of from about 30 Angstroms to about 1000 Angstroms, preferably about 50 Angstroms to about 500 Angstroms, and an average particle diameter of about 200 Angstroms. The invention provides a homogeneously dispersed material without agglomeration.

BRIEF DESCRIPTION OF THE DRAWINGS

A more complete understanding of the present invention can be obtained by reference to the accompanying Figure which is a cross-sectional view of a multilayer photoreceptor of the invention.

DESCRIPTION OF PREFERRED EMBODIMENTS

Figure 1:
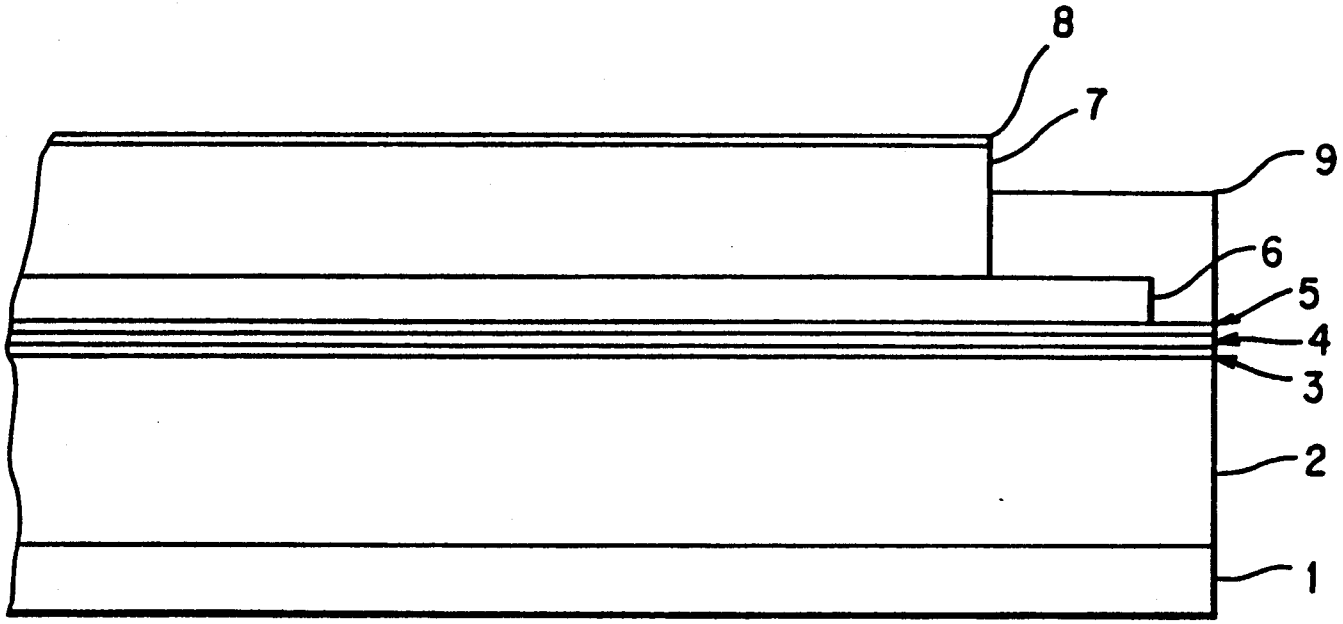

The electrophotographic imaging member according to the present invention contains at least one layer which includes homogeneously dispersed particulate metal oxides precipitated through chemical reaction. The small particle and homogeneous dispersion of particulate metal oxides in film forming polymer binders of, e.g., the charge transport layer, ground strip layer and anti-curl layer were unobtainable by conventional filler polymer blending techniques. The present invention allows for liquid chemical reactants to be directly mixed into the coating solutions prior to fabricating the imaging member.

A representative structure of an electrophotographic imaging member is shown in the Figure. This imaging member is provided with an anti-curl back coating 1, a supporting substrate 2, an electrically conductive ground plane 3, a hole blocking layer 4 an adhesive layer 5, a charge generating layer 6, and a charge transport layer 7. An optional overcoating layer 8 is also shown in the Figure.

In the above described device, a ground strip 9 may be provided adjacent the charge transport layer at an outer edge of the imaging member. See U.S. Pat. No. 4,664,995. The ground strip 9 is coated adjacent to the charge transport layer so as to provide grounding contact with a grounding device (not shown) during electrophotographic processes.

A description of the layers of the electrophotographic imaging member shown in the Figure follows.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex available from ICI Americas Inc.

The thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Hole Blocking Layer

After deposition of the electrically conductive ground plane layer, the hole blocking layer 4 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryrol, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. No(s). 4,338,387, 4,286,033 and 4,291,110. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

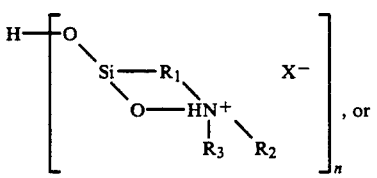

I

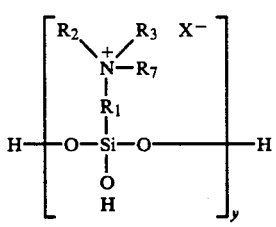

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and Y is 1–4. The imaging member is preferably prepared by depositing on the metal oxide layer of a metal conductive layer, a coating of an aqueous solution of the hydrolyzed aminosilane at a pH between about 4 and 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

In most cases, intermediate layers between the injection blocking layer and the adjacent charge generating or photogenerating layer may be desired to promote adhesion. For example, the adhesive layer 5 may be employed. If such layers are utilized, they preferably have a dry thickness between about 0.001 micrometer to about 0.2 micrometer. Typical adhesive layers include film-forming polymers such as copolyester, du Pont 49,000 resin (available from E.I. du Pont de Nemours & Co.), vitel-PE100 (available from Goodyear Rubber & Tire Co.), polyvinylbutryrol, polyvinylpyrolidone, polyurethane, polymethyl methacrylate, and the like.

The Charge Generating Layer

Any suitable charge generating (photogenerating) layer 6 may be applied to the adhesive layer 5 which can then be coated over with a contiguous hole transport layer as described. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating layer. Typical polymeric film forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved. Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The Active Charge Transport Layer

The active charge transport layer 7 may comprise any suitable transparent organic polymer or non-polymeric material capable of supporting the injection of photo-generated holes and electrons from the charge generating layer 6 and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It is comprised of a substantially non-photoconductive material which supports the injection of photogenerated holes from the charge generating layer. The active charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the active charge transport material need not transmit light in the wavelength region of use. The charge transport layer in conjunction with the charge generating layer is an insulator to the extent than an electrostatic charge placed on the charge transport layer is not conducted in the absence of illumination.

The active charge transport layer may comprise activating compounds dispersed in normally electrically inactive polymeric materials for making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

The charge transport layer is preferably formed from a mixture comprising an aromatic amine compound of one or more compounds having the general formula:

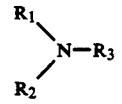

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic compounds having from 3 to 18 carbon atoms. The substituent should be free from electron withdrawing groups such as $NO_2$ groups, CN groups, and the like. Typical aromatic amine compounds that are represented by this structural formula include:

I. Triphenyl amines such as:

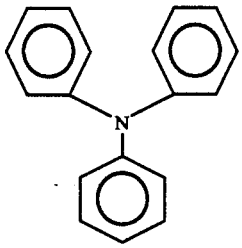

II. Bis and poly triarylamines such as:

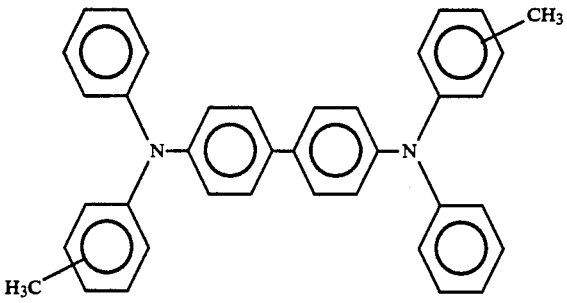

III. Bis arylamine ethers such as:

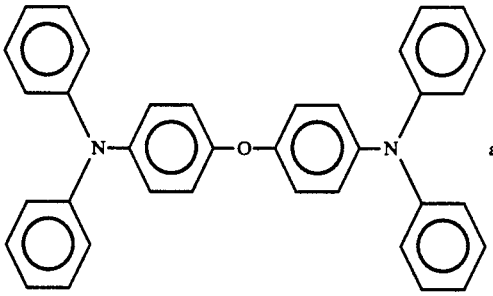

and

IV. Bis alkyl-arylamines such as:

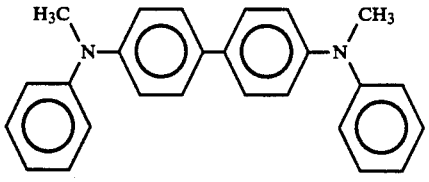

A preferred aromatic amine compound has the general formula:

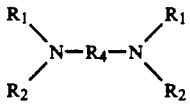

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron withdrawing groups such as $NO_2$ groups, CN groups, and the like.

Examples of charge transporting aromatic amines represented by the structural formulae above include triphenylmethane, bis(4-diethylamine-2-methylphenyl)-phenylmethane; 4'-4''-bis(diethylamino)-2',2''-dimethyltriphenylmethane, N,N-bis(alkyl-phenyl)-(1,1'-biphenyl)-4,4'-diamine wherein the alkyl is, for example, methyl, ethyl, propyl, n-butyl, etc., N,N'-diphenyl-N,N'-bis(3''-methylphenyl) -(1,1'biphenyl)-4,4'-diamine, and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; Makrolon, a polycarbonate resin having a molecular weight of from about 50,000 to about 100,000, available as Makrolon from Farben Fabricken Bayer A.G.; Merlon, a polycarbonate resin having a molecular weight of from about 20,000 to about 50,000 available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

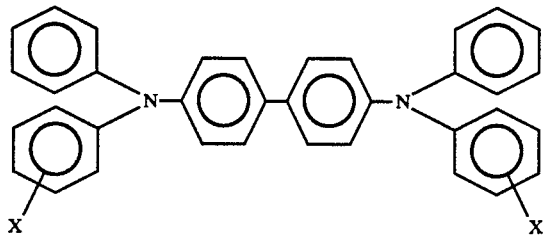

wherein X is selected from the group consisting of an alkyl group, having from 1 to about 4 carbon atoms and chlorine, the photoconductive layer exhibiting the capability of photogeneration of holes and injection of the holes, the hole transport layer being substantially nonabsorbing in the spectral region at which the photoconductive layer generates and injects photogenerated holes but being capable of supporting the injection of photogenerated holes from the photoconductive layer and transporting the holes through the hole transport layer.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip may comprise a film forming polymer binder and electrically conductive particles. Cellulose may be used to disperse the conductive particles. Any suitable electrically conductive particles may be used in the electrically conductive ground strip layer 9 of this invention. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Anti-Curl Layer

The anti-curl layer 1 may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film forming resin and an adhesion promoter polyester additive. Examples of film forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl layer is from about 3 micrometers to about 35 micrometers, and preferably about 14 micrometers.

The Overcoatinq Layer

The optional overcoating layer 8 may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

The Metal Oxides

In the above layers, the particulate metal oxides of the present invention may be incorporated directly into the solutions used to prepare such layers. The metal oxides may be precipitated in situ when applied to the imaging member.

Exposed layers such as the ground strip, charge transport layer, anti-curl layer and/or overcoats may be filled with particulate metal oxide to increase wear properties without adversely affecting the optical and electrical functions, producing substantial improvements in mechanical properties of the imaging member. The coating solutions for these layers may have metal oxide chemically precipitated in-situ to provide layers having particulate metal oxides homogeneously dispersed therein.

The particulate metal oxides of the invention have an average particle diameter of about 200 Angstroms in diameter. The particle diameter ranges from about 30 Angstroms to about 1,000 Angstroms. These metal oxide particles are much smaller than conventional microcrystalline particles which have particle diameters ranging from about 0.3 micrometers to about 4.9 micrometers. The particulate metal oxide of the present invention, and the chemical precipitation process for obtaining the particulate metal oxides, allow for homogeneous distribution of the particles.

The metal oxides of the invention include oxides of Si, Ti, Al, Cr, Zr, Sn, Fe, Mg, Mn, Ni, Cu and the like. The metal oxides may be formed from metal alkoxides or aryloxides of the formula $M(OR)_4$, where M is a metal, and R is an alkyl group having from 1–20 carbon atoms, phenyl or benzyl. The metal oxides are obtained by a sol-gel process. In the sol-gel process, a sol is obtained by suspending the metal alkoxide or aryloxide $M(OR)_4$ in an alcohol/aqueous medium in the presence of a catalyst. The metal alkoxide or aryloxide $M(OR)_4$ undergoes hydrolysis and then condenses to form a gel structure. The gels can be condensed to form the precipitated metal oxide particles. For ease of understanding of the invention, reference will be made hereinafter to a particular metal oxide, silica, used in a ground strip.

Silica may be chemically precipitated as the coating solutions are cast for the electrophotographic device. For example, a redetermined amount of tetraethylorthosilicate (TEOS) with a stoichiometric amount of water in the presence of a catalyst (such as acetic acid or base) can be added to a coating solution. The resulting mixture is vigorously agitated to ensure homogeneous solution mixing. Polymerization and cross-linking reactions lead to precipitation of silica particles in a polymer matrix. A specific example of this mechanism is shown below:

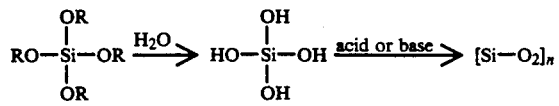

In the above reaction scheme, R may be a straight chain or branched alkyl group having from 1 to 20 carbon atoms, phenyl or benzyl provided that the R groups readily undergo hydrolysis. n is the number of repeating units in the crosslinked network structure which determines the size of the precipitated silica particle.

The above reaction is referred to as a sol-gel process. In the sol-gel process, a sol is obtained by suspending a liquid chemical in the presence of an acid or base catalyst in an alcohol/aqueous medium. The liquid chemical undergoes hydrolysis and then condenses to form a gel structure. In a wet cast layer, the gels can be easily condensed to form precipitated metal oxide particles. The layer is dried to remove solvent residue and reaction byproducts which may have become trapped among the condensed particles.

Metal oxide blends may also be used in the present invention. For example, co-precipitation of a titania-silica blend is possible by reacting TEOS with a similar titanium compound, for example $Ti(OR)_4$. In this embodiment, the addition of a catalyst can be omitted due to the high reactivity of the $Ti(OR)_4$ species (where R, for example, may be phenyl, benzyl, isopropyl, N-butyl, and 2-ethylhexyl). The ratio of each metal oxide species in the resulting particulate metal oxide blend can be varied by controlling the amount of each of the metal oxides used for sol-gel solution preparation. The reactivity can be controlled by changing the R groups for each metal oxide. For example, a metal oxide having a lower or higher reactivity will dramatically change the rate of reaction when incorporated into the reacting solution. If a high reactivity titanate is used without catalyst for aqueous alcohol sol-gel solution preparation, the hydrolysis and crosslinking rates without catalyst are so rapid that instantaneous precipitation of metal oxide will occur almost as soon as the chemical components are mixed together. In this instance, effective solution layer coating may be difficult.

The coating solutions of the invention can be applied by any of a number of known photoreceptor fabricating techniques. Typical coating techniques include solvent coating, extrusion coating, spray coating, dip coating, lamination, solution spin coating and the like. Further, the coating solutions can be used with seamless organic photoreceptor belt processes. The coated solutions may be dried by conventional drying techniques such as oven drying, forced air drying, circulating air oven drying, radiant heat drying, and the like.

Metal oxides of the invention can be present in various layers of the imaging member in a range of about 1% to about 25% by weight based on the weight of solids in the coating solutions for the layers. Optimum results are obtained when the coating mixture for the charge transport layer contains particulate metal oxide in a concentration of between about 1% by weight and about 3% by weight of polymer binder and charge transporting molecules in the charge transport layer.

Optimum results are obtained when the coating mixture for the ground strip layer contains particulate metal oxide in a concentration of between about 5% by weight and about 10% by weight of the binder (for example, polycarbonate, ethylcellulose and graphite) in the ground strip layer.

Optimum results are obtained when the coating mixture for an overcoating layer contains particulate metal oxide in a concentration of between about 5% by weight and about 10% by weight of the polymer binder and any other overcoating layer material in the overcoating layer.

Optimum results are obtained when the coating mixture for the anti-curl layer contains particulate metal oxide in a concentration of between about 5% by weight and about 10% by weight of the polymer binder and polyester adhesion promoter in the anti-curl layer.

Optimum results are obtained when the coating mixtures contain a solvent for the resin which has a high vapor pressure. When the coating mixtures are applied to fabricate the imaging member, and dried, the condensation polymerization and crosslinking processes which lead to precipitation of metal oxide are accelerated through the influence of heat coupled with rapid solvent evaporation from the thin film. The metal oxide particles are immobilized in the polymer matrix to form a layer in which the small metal oxide particles are homogeneously dispersed throughout the thickness of the film. This is particularly desirable for a uniform rate of wear during the life of the imaging member.

With the layers of the present invention, a decrease in surface contact friction is seen compared with layers which do not have the particulate metal oxides. Wear resistance is increased, resistance to tensile stress cracking in the charge transport layer is increased, and adhesion is promoted. Since the refractive index of metal oxide particles may closely match that of the polymer binder, no negative visible effects occur in the charge transport layer or the anti-curl layer. These advantageous effects are obtained while maintaining surface smoothness and without producing negative electrical impact.

The invention will further be illustrated in the following, non-limitative examples, it being understood that these examples are intended to be illustrative only and that the invention is not intended to be limited to the materials, conditions, process parameters and the like recited herein.

COMPARATIVE EXAMPLE I

A photoconductive imaging member is prepared by providing a titanium coated polyester (Melinex available from ICI Americas Inc.) substrate having a thickness of 3 mils, and applying thereto, using a gravure applicator, a solution containing 50 grams 3-aminopropyltriethoxysilane, 15 grams acetic acid, 684.8 grams of 200 proof denatured alcohol and 200 grams heptane. This layer is then dried for 10 minutes at 135° C. in a forced air oven. The resulting blocking layer has a dry thickness of 0.05 micrometer.

An adhesive interface layer is then prepared by the applying a wet coating over the blocking layer, using a gravure applicator, containing 0.5 percent by weight based on the total weight of the solution of polyester adhesive (DuPont 49,000, available from E.I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N-diphenyl-N,N'-bis(3-methylphenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is then placed on a shaker for 10 minutes. The resulting slurry is thereafter applied to the adhesive interface with an extrusion die to form a layer having a wet thickness of about 0.5 mil. However, a strip about 3 mm wide along one edge of the substrate, blocking layer and adhesive layer is deliberately left uncoated by any of the photogenerating layer material to facilitate adequate electrical contact by the ground strip layer that is applied later. This photogenerating layer is dried at 135° C. for 5 minutes in a forced air oven to form a photogenerating layer having a dry thickness of 2.3 micrometers.

This coated member is simultaneously overcoated with a charge transport layer and a ground strip layer by coextrusion of the coating materials through adjacent extrusion dies similar to the dies described in U.S. Pat. No. 4,521,457. The charge transport layer is prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecule weight of from about 50,000 to 100,000 commercially available from Larbensabricken Bayer A.G. The resulting mixture is dissolved by adding methylene chloride. This solution is applied on the photogenerator layer by extrusion to form a coating which upon drying has a thickness of 24 micrometers.

The strip about 3 mm wide left uncoated by the photogenerator layer is coextruded as a ground strip layer along with the charge transport layer. The ground strip layer coating mixture is prepared by combining 525 grams of polycarbonate resin (Makrolon 5705, available from Bayer A.G.), and 7,317 grams of methylene chloride in a carboy container. The container is covered tightly and placed on a roll mill for about 24 hours until the polycarbonate is dissolved in the methylene chloride. The resulting solution is mixed for 15–30 minutes with about 2,072 grams of a graphite dispersion (12.3 percent by weight solids) of 9.41 parts by weight graphite, 2.87 parts by weight ethyl cellulose and 87.7 parts by weight solvent (Acheson Graphite Dispersion RW22790, available from Acheson Colloids Company) with the aid of a high shear blade disperser (Tekmar Dispax Disperser) in a water cooled, jacketed container to prevent the dispersion from overheating and losing solvent. The resulting dispersion is then filtered and the viscosity is adjusted to between 325–375 centipoises with the aid of methylene chloride. This ground strip layer coating mixture is then applied to the photoconductive imaging member to form an electrically conductive ground strip layer having a dried thickness of about 15 micrometers.

During the transport layer and ground strip layer coextrusion coating process, the humidity is equal to or less than 15 percent. The resulting photoreceptor device containing all of the above layers is annealed at 135° C. in a forced air oven for 6 minutes.

An anti-curl coating is prepared by combining 882 grams of polycarbonate resin (Makrolon 5705, available from Bayer A.G.), 9 grams of copolyester resin (Vitel-PE 100, available from Goodyear Tire and Rubber Co.), and 9,007 grams of methylene chloride in a carboy container to form a coating solution containing 8.9 percent solids. The container is covered tightly and placed on a roll mill for about 24 hours until the polycarbonate and polyester are dissolved in the methylene chloride. The anti-curl coating solution is applied to the rear surface (side opposite the photogenerator layer and charge transport layer) of the photoconductive imaging member by extrusion coating and dried at 135° C. for about 5 minutes to produce a dried film having a thickness of 13.5 micrometers.

COMPARATIVE EXAMPLE II

A photoconductive imaging member having two electrically operative layers (the charge generating and the charge transport layers) as described in Example I is prepared using the same procedures, conditions, and materials except that the charge transport layer is applied using a 3 mil gap Bird applicator and the coating of the adjacent conductive ground strip layer is omitted. The dry charge transport layer obtained has a thickness of 24 micrometers.

EXAMPLE III

A photoconductive imaging member having two electrically operative layers is fabricated by repeating the procedures described in Example II, with the exception that the charge transport layer is loaded with 5% by weight in-situ precipitated silica of the present invention. A 40.2 grams solution of the invention containing 27.8 grams tetraethylorthosilicate (TEOS, available from Petrarch Systems, Inc.), 9.46 grams (a stoichiometric amount) of distilled water, and 2.8 grams of reagent grade acetic acid is prepared with vigorous agitation. This TEOS solution is then added to a container having 1,000 grams of charge transport layer coating solution and mixing is achieved with a high shear dispersing rotor (Tekmar Dispax Disperser). The resulting charge transport layer solution is then cast over the charge generating layer using a 3 mil gap Bird applicator. After drying at 135° C. for 5 minutes, approximately 5% by weight silica is precipitated in the polymer matrix of the 24 micrometers thick dry charge transport layer. The presence of silica particles is confirmed by energy dispersive X-ray analysis (EDXA). The homogeneous dispersion of silica particles in the charge transport layer is evident with transmission electron microscopy (TEM) at 50,000 times magnification. The average particle diameter of the precipitated silica is approximately 200 Angstroms.

EXAMPLE IV

The photoconductive imaging members of Examples II and III were tested for tensile cracking strain, 180° peel strength, and coefficient of friction. Tensile cracking strain is determined by cutting several 1.27 cm ×10.16 cm imaging member samples, inserting one sample into the jaws of an Instron Tensile Tester using a 5.08 cm gauge, and pulling the sample to 3% strain with a 5.1 mm/min crosshead speed. The tested sample is then removed from the Instron Tensile Tester and examined for charge transport layer cracking under a reflection optical microscope at 100 times magnification. If charge transport layer cracking does not occur, a fresh sample is tested following the same procedures, but at an increased incremental strain 0.25% higher than the previous one. The tensile strain testing is repeated, each time with a fresh sample, until charge transport layer cracking becomes evident. The strain at which the cracking occurs is recorded as the charge transport layers tensile cracking strain. The results obtained are given in the following Table I.

TABLE I

| Example | Cracking Strain (%) |
|---|---|
| II (Control) | 3.25 |
| III | 4.0 |

It is obvious that the resistance of a charge transport layer against tensile stress cracking is improved. Even with the presence of only 5% precipitated silica, the reinforcement effect seen for Example III is substantial. The observed tensile cracking improvement is expected to extend the dynamic fatigue cracking life of the charge transport layer by about two times against small diameter belt module rollers during machine function.

The 180° peel strength is determined by cutting a minimum of 0.5 inch ×6 inches imaging member samples from each of Examples II and III. For each sample, the charge transport layer is partially stripped from the test sample with the aid of a razor blade and then hand peeled to about 3.5 inches from one end to expose the underlying charge generating layer inside the sample. This stripped sample is then secured to a 1 inch ×6 inches ×0.5 inch aluminum backing plate (with the anti-curl layer facing the backing plate) with the aid of two sided adhesive tape. The end of the resulting assembly opposite the end from which the charge transport layer was not stripped is inserted into the upper jaw of an Instron Tensile Tester. The free end of the partially peeled charge transport layer is inserted into the lower jaw of the Instron Tensile Tester. The jaws are then activated at a one inch/min crosshead speed, a two inches chart speed and a load range of 200 grams, to 180° peel the sample at least two inches. The load is calculated to give the peel strength of the sample. The peel strength is determined to be the load required for stripping the charge transport layer divided by the width of the test sample.

The coefficient of friction test is conducted by fastening the photoconductive imaging member of Example II, with its charge transport layer (having no silica precipitation) facing up, to a platform surface. A photoconductive imaging member of Example I is then secured to the flat surface of the bottom of a horizontally sliding plate weighing 200 grams. The sliding plate is dragged in a straight line over the platform, against the horizontal test sample surface, with the outer surface of the anti-curl layer facing downwardly. The sliding plate is moved by a cable which has one end attached to the plate and the other end threaded around a low friction pulley and fastened to the Instron Tensile Tester. The pulley is positioned so that the segment of the cable between the weight and the pulley is parallel to the surface of the flat horizontal test surface. The cable is pulled vertically upward from the pulley by the Instron Tensile Tester. The coefficient of friction test for the charge transport layer against the anti-curl layer is repeated again as described but the photoconductive imaging member of Example II is replaced with the sample of Example III having 5% by weight silica precipitated in the charge transport layer. The coefficient of friction is calculated by dividing the load by 200 grams.

The results presented in Table II below show that the in-situ silica precipitation process improves the interfacial bond strength between the charge transport layer and the charge generating layer, and also produces marked reduction in the charge transport layer's frictional property.

TABLE II

| Example | 180° Peel Strength (gm/cm) | Coefficient of Friction (against anti-curl coating) Static | Dynamic |
|---|---|---|---|
| II (Control) | 98.2 | 3.02 | 0.84 |
| III | 99.8 | 1.02 | 0.63 |

EXAMPLE V

The photoconductive imaging members of Examples II and III are cut to the size of 1 inch by 12 inches and tested for resistance to wear. Testing is effected by means of a dynamic mechanical cycling device in which glass tubes are skidded across the surface of the charge transport layer on each photoconductive imaging member. More specifically, one end of the test sample is clamped to a stationary post and the sample is looped upward over three equally spaced horizontal glass tubes and then downwardly over a stationary guide tube through a generally inverted "U" shaped path with the free end of the sample secured to a weight which provides one pound per inch width tension on the sample. The face of the imaging member bearing the charge transport layer is facing downward such that it is allowed to contact the glass tubes. The glass tubes have a diameter of one inch. Each tube is secured at each end to an adjacent vertical surface of a pair of disks that are rotatable about a shaft connecting the centers of the disks. The glass tubes are parallel to and equidistant from each other and equidistant from the shaft connecting the centers of the disks. Although the disks are rotated about the shaft, each glass tube is rigidly secured to the disk to prevent rotation of the tubes around each individual tube axis. Thus, as the disk rotates about the shaft, two glass tubes are maintained at all times in sliding contact with the surface of the charge transport layer. The axis of each glass tube is positioned about 4 cm from the shaft. The direction of movement of the glass tubes along the charge transport layer surface is away from the weighted end of the sample toward the end clamped to the stationary post. Since there are three glass tubes in the test device, each complete rotation of the disk is equivalent to three wear cycles in which the surface of the charge transport layer is in sliding contact with a single stationary support tube during testing. The rotation of the spinning disk is adjusted to provide the equivalent of 11.3 inches per second tangential speed. The extent of the charge transport layer wear is measured using a permascope after 90,000 wear cycles and at the end of a 330,000 wear cycles testing. The wear results are listed in the following Table III:

TABLE III

| Example | After 30,000 Wear Cycles Micrometers | After 330,000 Wear Cycles Micrometers |
|---|---|---|
| II (Control) | 5 | 8.5 |
| III | 2.3 | 4.2 |

These data indicate that the wear resistance of the charge transport layer having 5 percent by weight precipitated silica (Example III) is improved by over about 2 times.

EXAMPLE VI

The electrical properties of the photoconductive imaging samples prepared according to Examples II and III are evaluated with a xerographic testing scanner comprising a cylindrical aluminum drum having a diameter of 9.55 inches. The test samples are taped onto the drum. When set to rotation, the drum which carries the samples produces a constant surface speed of 30 inches per second. A direct current pin corotron, exposure light, erase light, and five electrometer probes are mounted around the periphery of the mounted photoreceptor samples. The sample charging time is 33 milliseconds. Both exposed and erase light are broad band white light (400–700 nm) outputs, each supplied by a 300 watt output Xenon arc lamp. The relative locations of the probes and lights are indicated in Table IV below:

TABLE IV

| ELEMENT | ANGLE (Degrees) | POSITION | DISTANCE FROM PHOTORECEPTOR |
|---|---|---|---|
| CHARGE | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples are first rested in the dark for at least 60 minutes to ensure achievement of equilibrium with the testing conditions at 40% relative humidity and 21° C. Each sample is then negatively charged in the dark to a development potential of about 900 volts. The charge acceptance of each sample and its residual potential after discharge by front erase exposure to 400 ergs/cm$^2$ of light exposure are recorded. The test procedure is repeated to determine the photo induced discharge characteristic (PIDC) of each sample by different light energies of up to 20 ergs/cm$^2$.

50,000 cycles electric results obtained for the test samples in both examples II and III give equivalent dark decay potential, background voltage, the extent of electrical cycle down after 50,000 cycles of testing, and photo-induced discharge characteristic curves. These electrical cyclic results are of particular importance because they indicate that in-situ silica precipitation in the charge transport layer of the present invention not only improves the desired mechanical and frictional properties of the charge transport layer, but that the crucial electrical integrity of the photoconductive imaging member is also maintained.

COMPARATIVE EXAMPLE VII

A conductive ground strip layer is fabricated by first providing a 3 mil polyester substrate (Melinex 442, available from ICI Americas, Inc.) and applying thereto, using a 0.5 mil gap Bird applicator, an adhesive layer solution containing 0.5% by weight, based on the total weight of the solution, du Pont 49,000 copolyester adhesive in a 70:30 volume ratio mixture of tetrahydrofuran/cyclohexanone. The adhesive wet coating is allowed to dry for 5 minutes at room temperature and then 5 minutes at 135° C. in a forced air oven. The resulting adhesive layer has a dry thickness of 0.05 micrometer.

The adhesive layer is thereafter coated with a ground strip layer of the same materials described in Example I. The ground strip layer is prepared by dissolving 52.5 grams polycarbonate resin (Makrolon 5705, available from Bayer A.G.) with 731.7 grams methylene chloride in a plastic container. The container is covered tightly and placed on a roll mill for about 24 hours for the polycarbonate to dissolve. The solution is mixed for about 30 minutes with 207.2 grams of a 12.3% by weight solid dispersion comprising 9.43 parts by weight graphite, 2.87 parts by weight ethylcellulose, in 87.7 parts by weight methylene chloride solvent (Acheson Graphite Dispersion RW 22790, available from Acheson Colloids Company). The resulting dispersion/solvent mixture is homogeneously dispersed with a high shear Tekmar Dispax Dispersator in a water cooled jacketed container to prevent the dispersion from overheating and to prevent loss of solvent due to evaporation. The final ground strip coating mixture is then applied to the adhesive/polyester supporting substrate with a 5 mil gap Bird applicator. The wet coating is dried for 5 minutes at 135° C. in a forced air oven to form a final conductive ground strip thickness of about 15 micrometers.

EXAMPLE VIII

A conductive ground strip of the present invention is fabricated by using the same materials and procedures described in Example VII, except that a 20 grams solution of hydrolyzed TEOS (taken from a solution prepared and described in Example III) is added to the ground strip layer dispersion/solvent mixture with the aid of a high shear blade disperser (Tekmar Dispax Disperser) in a water cooled jacketed container to prevent the dispersion from overheating and to prevent solvent loss. The resulting ground strip layer coating mixture is then applied over the adhesive/polyester supporting substrate using a 5 mil gap Bird applicator, and dried at 135° C. for 5 minutes in a forced air oven to give 15 micrometers thickness and 5% by weight precipitated silica.

EXAMPLE IX

A conductive ground strip layer of the present invention is fabricated in the same manner as described in Example VII, except that a 40 grams solution of hydrolyzed TEOS (taken from a solution prepared by following the procedures in Example III) is used to chemically precipitate 10% by weight silica in a round strip layer having a 15 micrometers dry thickness.

EXAMPLE X

A conductive ground strip layer of the present invention is fabricated by repeating the procedures described in Example IX, with the exception that tetra-n-butyl titanate (TYZOR TBT, available from du Pont) is added to a TEOS solution to form a 1:3 mol ratio of TBT/TEOS in the final hydrolyzed solution. When added to the ground strip dispersion/solvent mixture for coating onto an adhesive/polyester supporting substrate, 10% by weight particles of $(SiO_2)_3$-$(TiO_2)$ metal oxide particle blend are precipitated in a ground strip layer having a 15 micrometers thickness.

EXAMPLE XI

The conductive ground strip layer coatings in Examples VII through X are tested for electrical conductivity and wear resistance. The test results show that in-situ metal oxide precipitation at 5 and 10% by weight levels does not significantly change the electrical conductivity to affect the ground strip layer's function. As shown by the results of bulk electrical resistivity measurements in Table V below, all ground strip layers exhibit a bulk electrical resistivity much less than the resistivity limits of $10^4$ ohm-cm. That is, the internal metal oxide filled ground strip layers are highly conductive at all levels of $SiO_2$ or $(SiO_2)_3$-$(TiO_2)$ loadings.

TABLE V

| Example | Bulk Resistivity (ohm-cm) |
|---|---|
| VII (Control) | 12 |
| VIII | 16 |
| IX | 18 |
| X | 18 |

The wear testing carried out according to the procedures described in Example V give very encouraging results. The wear resistance of the ground strip layer of the present invention is enhanced by about 3 times when 5% by weight silica is present in the ground strip polymer matrix. The wear resistance is further increased by more than 10 times as the precipitation of metal oxide, both silica and $(SiO_2)_3$-$(TiO_2)$ blend, is increased to 10% by weight based on the total weight of the dry ground strip layer.

EXAMPLE XII

The conductive ground strip layers of Examples VII through IX are evaluated for ground strip coating adhesion to an adhesive/polyester supporting substrate by a tape peel test. To prepare the sample for adhesion determination, a cross-hatched pattern was formed on each ground strip layer by cutting through the thickness of the ground strip layer with a razor blade. The cross hatch pattern consists of perpendicular slices 5 mm apart to form tiny squares in the ground strip layer. A tape peel test is made with two different adhesive tapes: one is Scotch Brand Magic Tape No. 810 available from 3M Corporation, having a width of 0.75 inch; and the other is Fas Tape No. 445, available from Fasson Industrial Division, Avery International.

The adhesive tapes of each manufacturer are pressed onto every ground strip layer test sample. After application of the tapes, the tape of each brand is peeled 90° from the surface of the ground strip layer. Peeling off the tapes fails to remove any of the cross-hatched pattern from the underlying adhesive coating of the ground strip layers having metal oxide precipitation. In the control counterpart of Example VII, portions of the cross-hatched pattern are removed. The tape peel results demonstrate that in-situ metal oxide precipitation of the present invention is effective to improve the adhesion strength of the ground strip layer to the underlying adhesive/polyester supporting substrate.

COMPARATIVE EXAMPLE XIII

An anti-curl layer is fabricated by providing a 3 mil polyester substrate (Melinex 442, available from ICI Americas, Inc.) and applying thereto, using a 5 mil gap Bird applicator, a coating solution containing 88.2 grams polycarbonate resin (Makrolon 5705, available from Bayer A.G.), 0.9 grams copolyester resin (Vitel-PE 100, available from Goodyear Tire and Rubber Company), and 900.7 grams methylene chloride. The wet coated layer is dried at 135° C. for about 5 minutes in a forced air oven to give a final anti-curl layer of 14 micrometers.

EXAMPLE XIV

An anti-curl layer having 5 percent by weight silica precipitation of the present invention is prepared by using the same material and procedures described in Example XIII, except that 22.5 grams solution of hydrolyzed TEOS (taken from a solution prepared according to the procedures described in Example III) is added to the anti-curl coating solution. The solution is further mixed with the aid of a high shear Tekmar Dispax Disperser in a water cooled jacketed container to prevent solution overheating and solvent loss due to evaporation. The resulting solution is then applied over the polyester supporting substrate and dried at 135° C. for 5 minutes in a forced air oven to form a 14 micrometers dried anti-curl layer having 5 percent by weight silica precipitation.

EXAMPLE XV

An anti-curl layer having 10 percent by weight silica precipitation is prepared by using the same material and procedures described in Example XIII, except that a 45 grams solution of hydrolyzed TEOS (taken from a solution prepared according to the procedures described in Example III) is added to the anti-curl solution to chemically precipitate 10 percent by weight silica in the dried anti-curl coating.

EXAMPLE XVI

An anti-curl layer of the present invention is fabricated by repeating the procedures described in Example XV, with the exception that tetra-n-butyl titanate (TYZOR TBT, available from du Pont) is included in the TEOS solution during preparation to form a 1:3 mol ratio of TBT/TEOS in the final hydrolyzed solution. When added to the coating solution, a 10 percent by weight blend of $(SiO_2)_3$-$(TiO_2)$ metal oxide particles is precipitated in the anti-curl layer.

EXAMPLE XVII

The anti-curl layers of the present invention are tested for 180° peel strength, coefficient of surface contact friction, wear resistance, and optical transmission.

The 180° peel strength is determined by cutting a minimum of five 0.5 inch ×6 inches imaging member samples from each of Examples XIII through XVI. For each sample, the anti-curl layer is partially stripped from the supporting polyester substrate with the aid of a razor blade and then hand peeled to about 3.5 inches from one end to expose part of the underlying polyester substrate. The polyester substrate is secured to a 1 inch ×6 inches ×0.5 inch aluminum backing plate with the aid of two sided adhesive tape. The end of the resulting assembly opposite to the end from which the anti-curl layer was not stripped is inserted into the upper jaws of an Instron Tensile Tester. The free end of the partially peeled anti-curl layer is inserted into the lower jaws of the Instron Tensile Tester. The jaws are then activated at a 1 in/min crosshead speed, a 2 inch chart speed and a load range of 200 grams to 180° peel the sample at least 2 inches. The load is calculated to give the peel strength by dividing the average load required for stripping the anti-curl layer by the width of the test sample.

The coefficient of surface contact friction against the charge transport layer of Example II for each anti-curl layer of Examples XIII through XVI is evaluated. The coefficient of friction test is carried out by first anchoring an anti-curl layer sample (with the anti-curl layer face up) to a platform surface. The photoconductive imaging member of Example II is then secured to the bottom surface of a horizontally sliding plate weighing 200 grams. The sliding plate, having the imaging member with its charge transport layer facing downward, is dragged in a straight line over the platform against the anti-curl layer. The sliding plate is connected to one end of a thin cable threaded around a low friction pulley and attached to an Instron jaw, and is dragged when the cable is pulled by the Instron Tester. The coefficient of friction for the anti-curl coating against itself is conducted by repeating the procedures again, except that the attachment of the photoconductive imaging member of Example II to the bottom surface of the sliding plate is replaced by a sister anti-curl layer sample of the same sample as that anchoring over the platform.

The wear resistance of the anti-curl layers are dynamically evaluated against glass tube skidded interaction according to the testing procedures described in Example V. The results obtained for peel strength, coefficient of friction and resistance to wear testing for all the anti-curl layers are shown in Table VI.

TABLE VI

| EXAMPLE | 180° Peel Strength (gm/cm) | Static Coefficient of Friction Against | |
|---|---|---|---|
| | | Transport Layer | Itself |
| XIII (control) | 23 | 2.90 | 3.1 |
| XIV | 40 | 0.81 | 0.76 |
| XV | 45 | 0.75 | 0.71 |
| XVI | 46 | 0.72 | 0.73 |

The results in Table VI illustrate that the adhesion strength between the anti-curl layer and the polyester supporting substrate is increased by about 2 times as a result of metal oxide precipitation. Furthermore, the effect of in-situ metal oxide precipitation on surface contact friction is phenomenal because the anti-curl layer's coefficient of friction is reduced by more than 3 times either by testing against a control charge transport layer or against itself.

The results obtained for wear resistance against glass tube skidded interaction indicate that in-situ metal oxide precipitation substantially improves resistance to wear of the anti-curl layer. At 10 percent by weight precipitation, the anti-curl layer exhibited a 10 times wear resistance improvement. It is also important to note that metal oxide precipitation, at both experimental loading levels, does not alter the anti-curl layer's optical transmittancy, which is measured using a transmission spectrophotometer. The maintenance of optical clarity of the anti-curl layer is essential to allow back erase during photoelectric imaging processes.

While the invention has been described with reference to particular preferred embodiments, the invention is not limited to the specific examples given, and other embodiments and modifications can be made by those skilled in the art without departing from the spirit and scope of the invention.

What is claimed is:

1. An electrophotographic imaging member comprising a layer containing homogeneously dispersed metal oxide particles with a particle diameter of about 30 Angstroms to about 1000 Angstroms, said metal oxide particles having been produced through internal precipitation in a coating solution for said layer.

2. The imaging member of claim 1, wherein said layer is a ground strip layer comprising a film forming polymer binder, an electrically conductive grounding material, and said metal oxide particles.

3. The imaging member of claim 1, wherein said layer is a charge transport layer comprising a charge transport material, a film forming polymer binder, and said metal oxide particles.

4. The imaging member of claim 1, wherein said layer is an anti-curl back coating layer comprising a film forming polymer binder, an adhesion promoter, and said metal oxide particles.

5. The imaging member of claim 1, wherein said layer is an overcoating layer comprising an insulating or slightly semi-conductive polymer and said metal oxide particles.

6. The imaging member of claim 1, wherein said metal oxide particles are obtained from a solution of metal alkoxide or aryloxide of the formula $M(OR)_4$, wherein M is a metal and R is an alkyl, benzyl or phenyl group.

7. The imaging member of claim 1, wherein said metal oxide is at least one oxide of a compound selected from the group consisting of Si, Ti, Cr, Sn, Fe, Mg, Mn, Ni, Cu and Al.

8. The imaging member of claim 1, wherein said metal oxide is at least one member selected from the group consisting of $SiO_2$, $TiO_2$, and $Al_2O_3$.

9. The imaging member of claim 1, wherein the metal oxide is an oxide blend of Si and Ti.

10. The imaging member of claim 1, wherein said layer comprises about 1% to about 25% metal oxide by weight.

11. The imaging member of claim 1, wherein said metal oxide particles have an average particle diameter of about 200 Angstroms.

12. An electrophotographic imaging member comprising a ground strip comprised of a film forming polymer binder, a conductive grounding material, and metal oxide particles, said particles having been produced from a solution of metal alkoxide or aryloxide of the formula $M(OR)_4$, wherein M is a metal and R is an alkyl, benzyl, or phenyl group in a solution of said film forming polymer binder, and said conductive grounding material.

13. The imaging member of claim 12, wherein said internal precipitation comprises hydrolyzing said solution, and condensing said hydrolyzed solution to precipitate metal oxide particles of a highly crosslinked network structure.

14. The imaging member of claim 12, wherein said metal oxide particles have a particle diameter from about 30 Angstroms to about 1000 Angstroms.

15. The imaging member of claim 12, wherein said metal oxide particles are homogeneously dispersed in said film forming binder.

16. The imaging member of claim 12, wherein said metal is selected from the group consisting of Si, Ti, Cr, Sn, Fe, Mg, Mn, Ni, Cu and Al.

17. An electrophotographic imaging member comprising of a charge transport layer comprised of a film forming polymer binder, a charge transport compound and metal oxide particles, said particles having been produced by internal precipitation of metal oxide particles from a solution of metal alkoxide or aryloxide of the formula $M(OR)_4$, wherein M is a metal and R is an alkyl, benzyl or phenyl group in a solution of said film forming polymer binder and said charge transport compound.

18. The charge transport layer of claim 17, wherein said internal precipitation comprises hydrolyzing said solution, and condensing said hydrolyzed solution to precipitate metal oxide particles having a highly crosslinked network structure.

19. The image member layer of claim 17, wherein said metal oxide particles have a particle diameter of about 30 Angstroms to about 1000 Angstroms.

20. The image member layer of claim 17, wherein said metal oxide particles are homogeneously dispersed in said film forming polymer binder.

21. The imaging member layer of claim 17, wherein said metal is selected from the group consisting of Si, Ti, Cr, Sn, Fe, Mg, Mn, Ni, Cu and Al.

22. An electrophotographic imaging member comprising an anti-curl back coating comprised of a film forming polymer binder, adhesion promoter, and particulate metal oxide particles, said particles having been produced by internal precipitation of particulate metal oxide particles from a solution of metal alkoxide or aryloxide of the formula $M(OR)_4$, wherein M is a metal and R is an alkyl, benzyl, or phenyl group in a solution of said film forming polymer binder.

23. The imaging member of claim 22, wherein said internal precipitation comprises hydrolyzing said solution, and condensing said hydrolyzed solution to precipitate metal oxide particles having a highly crosslinked network structure.

24. The imaging member of claim 22, wherein said metal oxide particles have a particle diameter of about 30 Angstroms to about 1000 Angstroms.

25. The imaging member of claim 22, wherein said metal oxide particles are homogeneously dispersed in said film forming polymer binder.

26. The imaging member of claim 22, wherein said metal is selected from the group consisting of Si, Ti, Cr, Sn, Fe, Mg, Mn, Ni, Cu and Al.

27. A method of forming a layer of an electrophotographic imaging member, comprising:

hydrolyzing a metal alkoxide or aryloxide of the formula $M(OR)_4$, wherein M is a metal and R is an alkyl, benzyl or phenyl, in a solution containing a film forming polymer binder to form a sol-gel structure in the solution;

performing one of the steps (a) and (b):

(a) precipitating the sol-gel structure having a loosely crosslinked network from said solution, and coating said precipitate-containing solution onto a supporting substrate to form a wet film; and (b) coating said solution and sol-gel structure onto a supporting substrate, and precipitating the sol-gel structure having a loosely crosslinked network from said coated solution to form a wet film; and condensing said wet film by drying to obtain a material having said metal oxide particles homogeneously dispersed therein.

28. The method of claim 27, wherein said metal oxide particles have a particle diameter from about 30 Angstroms to about 1000 Angstroms.

* * * * *